US011548308B2

(12) United States Patent
Busch et al.

(10) Patent No.: US 11,548,308 B2
(45) Date of Patent: Jan. 10, 2023

(54) ORDERING OF COLOR-FORMING LAYERS IN A DIRECT THERMAL PRINTING MEDIUM

(71) Applicant: ZINK HOLDINGS, LLC, Billerica, MA (US)

(72) Inventors: Brian D. Busch, Sudbury, MA (US); Chien Liu, Wayland, MA (US); Suhail S. Saquib, Shrewsbury, MA (US); Stephen J. Telfer, Arlington, MA (US); William T. Vetterling, Lexington, MA (US)

(73) Assignee: ZINK HOLDINGS, LLC, Billerica, MA (US)

( * ) Notice: Subject to any disclaimer, the term of this patent is extended or adjusted under 35 U.S.C. 154(b) by 0 days.

(21) Appl. No.: 17/293,439

(22) PCT Filed: Nov. 14, 2019

(86) PCT No.: PCT/US2019/061452
§ 371 (c)(1),
(2) Date: May 12, 2021

(87) PCT Pub. No.: WO2020/102515
PCT Pub. Date: May 22, 2020

(65) Prior Publication Data

US 2021/0402818 A1 Dec. 30, 2021

Related U.S. Application Data

(60) Provisional application No. 62/767,935, filed on Nov. 15, 2018.

(51) Int. Cl.
*B41J 2/325* (2006.01)
*B41M 5/34* (2006.01)
*B41J 2/36* (2006.01)

(52) U.S. Cl.
CPC ..... *B41M 5/34* (2013.01); *B41J 2/325* (2013.01); *B41J 2/36* (2013.01)

(58) Field of Classification Search
CPC ..... B41M 5/282; B41M 7/0081; B41M 5/34; B41J 2/325; B41J 2/36; B41J 2/32; B41J 2/315; B41F 16/00; B41F 16/0006
See application file for complete search history.

(56) References Cited

U.S. PATENT DOCUMENTS

2014/0187418 A1* 7/2014 Busch ..... B41J 2/36 503/204

* cited by examiner

*Primary Examiner* — Kristal Feggins
(74) *Attorney, Agent, or Firm* — Adler Pollock & Sheehan P.C; Michel Morency

(57) ABSTRACT

The present invention relates generally to a printing system, and more specifically to an ordering of color-forming layers in a direct thermal printing medium. The present invention provides a direct thermal print medium with an ordering of the color layers that improves the perceived image sharpness and color uniformity of prints.

14 Claims, 17 Drawing Sheets

(a)

ID1226

(b)

TS425

(c)

AD128

(a)

ID923

(b)

TS376

(a)

ID1036

(b)

TS395

(c)

TS274

(a)

ID1322

(b)

AD139

(a)

ID1283

(b)

AD134

ORDERING OF COLOR-FORMING LAYERS IN A DIRECT THERMAL PRINTING MEDIUM

FIELD OF THE INVENTION

The present invention relates generally to a printing system, and more specifically to an ordering of color-forming layers in a direct thermal printing medium. In general, a direct thermal printer uses its printhead to heat special, chemically-treated, label stock. The print is created when parts of the label stock darken in response to the heat.

BACKGROUND OF THE INVENTION

Direct thermal color printing medium have been known in the art for almost 50 years. See, e.g., U.S. Pat. Nos. 3,488,705; 3,745,009. Prior art direct thermal imaging systems have used several different chemical mechanisms to produce a change in color. Some have employed compounds that are intrinsically unstable, and which decompose to form a visible color when heated. See, e.g., U.S. Pat. Nos. 3,488,705; 3,745,009; 3,832,212; 4,380,629; 4,720,449; 4,243,052; 4,602,263; and 5,350,870. Other prior art thermal imaging media depend upon melting to trigger image formation. Typically, two or more chemical compounds that react together to produce a color change are coated onto a substrate in such a way that they are segregated from one another, for example, as dispersions of small crystals. Melting, either of the compounds themselves or of an additional fusible vehicle, brings them into contact with one another and causes a visible image to be formed. See, e.g., U.S. Pat. Nos. 2,417,897; 4,636,819. Such thermal imaging materials and various combinations thereof are now well known, and various methods of preparing heat-sensitive recording elements employing these materials also are well known and have been described, for example, in U.S. Pat. Nos. 3,539,375, 4,401,717 and 4,415,633.

Over the past two decades, there have been several efforts to improve the direct thermal color printing medium in the art. See, e.g., U.S. Pat. Nos. 6,801,233; 7,008,759; 7,166,558; 7,176,161; 7,220,868; 7,279,264; 7,282,317; 7,504,360; 7,635,660; 7,704,667; 7,807,607; 8,372,782; 8,377,844; 8,502,848; 8,722,574.

As the state of the art in imaging systems advances and efforts are made to provide new imaging systems that can meet new performance requirements, and to reduce or eliminate some of the undesirable characteristics of the known systems, it would be advantageous to have new direct thermal print medium systems with an ordering of the color layers that improves the perceived image sharpness and color uniformity of prints.

SUMMARY OF THE INVENTION

The following presents a simplified summary of the innovation in order to provide a basic understanding of some aspects of the invention. This summary is not an extensive overview of the invention. It is intended to neither identify key or critical elements of the invention nor delineate the scope of the invention. Its sole purpose is to present some concepts of the invention in a simplified form as a prelude to the more detailed description that is presented later.

In one aspect of the present invention, there is disclosed a direct thermal print medium with an ordering of the color layers that improves the perceived image sharpness and color uniformity of prints. In one embodiment, the invention features a multicolor direct thermal printer output medium including a surface and three separate color-forming layers capable of forming the colors cyan (C), magenta (M) and yellow (Y) with the yellow color former is the bottom color-forming layer. In another embodiment, the cyan color former is the top color-forming layer and the magenta color former is the middle color-forming layer. In yet another embodiment, the thermal printer output medium also includes a first inert layer between the top and middle color-forming layers, and a second inert layer between the middle and bottom color-forming layers.

In another aspect of the present invention, there is disclosed a multicolor direct thermal printing system with a multicolor direct thermal printer comprising one or more print heads, each of the one or more print heads containing a linear array of heating elements and an output medium. The output medium is transported past the print head elements to produce a two-dimensional image. The output medium has a surface, a top forming layer of cyan (C), a middle color-forming layer of magenta (M), a bottom color-forming layer of yellow (Y), a first inert layer between the top and middle color-forming layers, and a second inert layer between the middle and bottom color-forming layers.

In yet another aspect of the present invention, there is disclosed a method of enhancing the image sharpness of a multicolor direct thermal printer output by using an output medium with a structure of color order of: a top forming layer of cyan (C), a middle color-forming layer of magenta (M), and a bottom color-forming layer of yellow (Y).

In yet another aspect of the present invention, there is disclosed a method of enhancing the print uniformity of a multicolor direct thermal printer output by using an output medium with a structure of color order of: a top forming layer of cyan (C), a middle color-forming layer of magenta (M), and a bottom color-forming layer of yellow (Y).

BRIEF DESCRIPTION OF THE DRAWINGS

For the purpose of illustration, certain embodiments of the present invention are shown in the drawings described below. Like numerals in the drawings indicate like elements throughout. It should be understood, however, that the invention is not limited to the precise arrangements, dimensions, and instruments shown. In the drawings:

FIG. 3 provides a schematic illustration of the two extremes of the color formation process.

DETAILED DESCRIPTION

Figure 1:
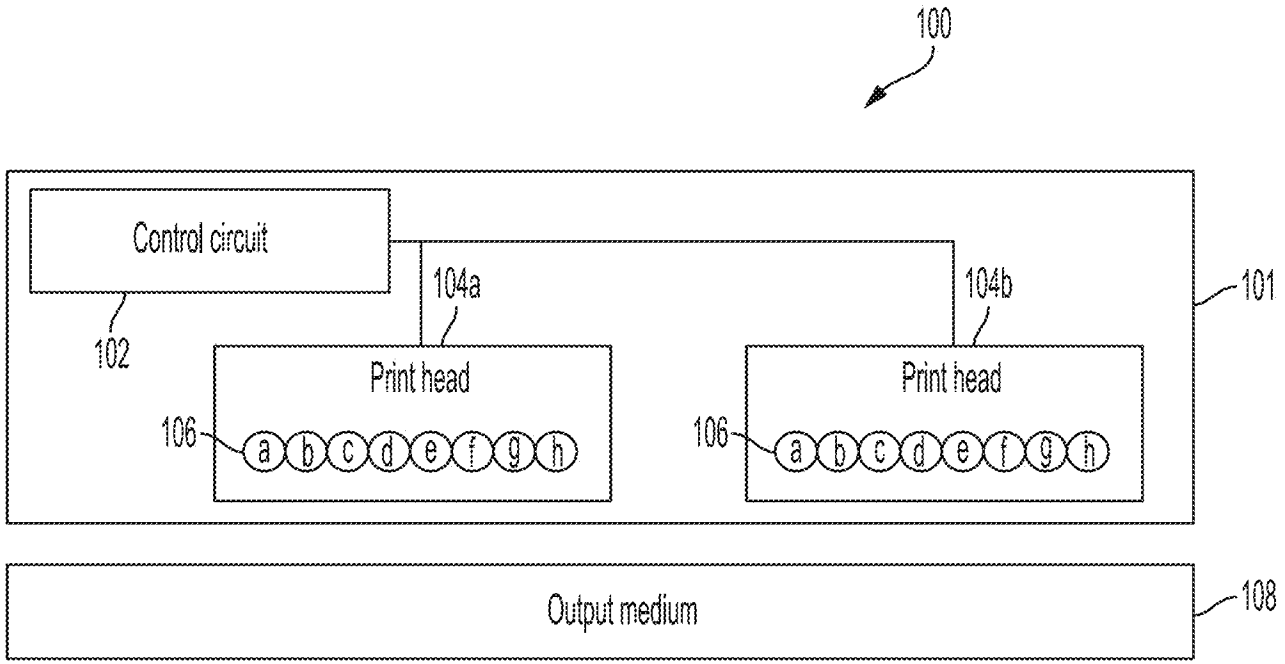
FIG. 1 is a block diagram of an exemplary direct thermal printing system.

The subject innovation is now described with reference to the drawings, wherein like reference numerals are used to refer to like elements throughout. In the following description, for purposes of explanation, numerous specific details are set forth in order to provide a thorough understanding of the present invention. It may be evident, however, that the present invention may be practiced without these specific details. In other instances, well-known structures and devices are shown in block diagram form in order to facilitate describing the present invention.

Definitions

For convenience, the meaning of some terms and phrases used in the specification, examples, and appended claims, are provided below. Unless stated otherwise, or implicit from context, the following terms and phrases include the meanings provided below. The definitions are provided to aid in describing particular embodiments, and are not intended to limit the claimed invention, because the scope of the invention is limited only by the claims. Unless otherwise defined, all technical and scientific terms used herein have the same meaning as commonly understood by one of ordinary skill in the art to which this invention belongs. If there is an apparent discrepancy between the usage of a term in the art and its definition provided herein, the definition provided within the specification shall prevail.

As used in this specification and the appended claims, the singular forms "a," "an" and "the" include plural referents unless the content clearly dictates otherwise. For example, reference to "a cell" includes a combination of two or more cells, and the like.

As used herein, the term "approximately" or "about" in reference to a value or parameter are generally taken to include numbers that fall within a range of 5%, 10%, 15%, or 20% in either direction (greater than or less than) of the number unless otherwise stated or otherwise evident from the context (except where such number would be less than 0% or exceed 100% of a possible value). As used herein, reference to "approximately" or "about" a value or parameter includes (and describes) embodiments that are directed to that value or parameter. For example, description referring to "about X" includes description of "X".

As used herein, the term "or" means "and/or." The term "and/or" as used in a phrase such as "A and/or B" herein is intended to include both A and B; A or B; A (alone); and B (alone). Likewise, the term "and/or" as used in a phrase such as "A, B, and/or C" is intended to encompass each of the following embodiments: A, B, and C; A, B, or C; A or C; A or B; B or C; A and C; A and B; B and C; A (alone); B (alone); and C (alone).

As used herein, the term "comprising" means that other elements can also be present in addition to the defined elements presented. The use of "comprising" indicates inclusion rather than limitation.

The term "consisting of" refers to compositions, methods, and respective components thereof as described herein, which are exclusive of any element not recited in that description of the embodiment.

As used herein the term "consisting essentially of" refers to those elements required for a given embodiment. The term permits the presence of additional elements that do not materially affect the basic and novel or functional characteristic(s) of that embodiment of the invention.

The terms "increased", "increase", "enhance", "enhanced", improve", or "improved" are all used herein to mean an increase by a significant amount. In some embodiments, the terms "increase", "increased", "enhance", "enhanced", improve", or "improved" can mean an increase of at least 10% as compared to a reference level, for example an increase of at least about 20%, or at least about 30%, or at least about 40%, or at least about 50%, or at least about 60%, or at least about 70%, or at least about 80%, or at least about 90% or up to and including a 100% increase or any increase between 10-100% as compared to a reference level, or at least about a 2-fold, or at least about a 3-fold, or at least about a 4-fold, or at least about a 5-fold or at least about a 10-fold increase, or any increase between 2-fold and 10-fold or greater as compared to a reference level.

Other terms are defined herein within the description of the various aspects of the invention. Unless otherwise defined herein, scientific and technical terms used in connection with the present application shall have the meanings that are commonly understood by those of ordinary skill in the art to which this disclosure belongs. It should be understood that this invention is not limited to the particular methodology, protocols, and reagents, etc., described herein and as such can vary. The terminology used herein is for the purpose of describing particular embodiments only and is not intended to limit the scope of the present invention, which is defined solely by the claims.

Ordering of Color-Forming Layers in a Direct Thermal Printing Medium

In FIG. 1, an exemplary thermal printer 101 includes one or more print heads 104*a-b*, each containing a linear array of heating elements 106*a-h* also referred to herein as "print head elements" that are activated by a control circuit 102 to print on an output medium 108. The output medium is transported past the print head elements to produce a two-dimensional image. The printing results from heating of the output medium 108 by applying electrical pulses to the individual print head elements 106*a-h* to heat them.

Each of the print head elements 106 *a-h*, when electrically activated, produces a colored spot on a portion of the passing output medium 108. Regions with larger or denser spots are perceived as darker than regions with smaller or less-dense spots. Digital images are rendered as two-dimensional arrays of very small and closely-spaced spots.

Printers of this type are generally divided into two broad categories, known respectively as "thermal transfer printers" and "direct thermal printers." Thermal transfer printers use the thermal energy from the print head elements to transfer pigment or dye from a donor ribbon to the output medium 108. The mechanism for this transfer may be mass transfer of a melted colored wax or resin, or thermal diffusion or sublimation of a colorant from one solid layer to another. Direct thermal printers use thermal energy from the print head element to activate a color-forming chemistry that pre-exists in the output medium 108. The direct thermal printer does not require a donor ribbon.

The density of the output produced by the print head element is a function of the amount of electrical energy provided to the print head element. It may be varied, for example, by varying the amount of power provided to the print head element within a particular time interval, or by providing a fixed power to the print head element for a longer or shorter time interval.

In U.S. Pat. No. 7,635,660 (the '660 patent), entitled "Thermal Imaging System" and incorporated herein by reference, there is described a direct-thermal imaging system in which one or more print heads 104*a,b* can print multicolor images in a single pass on output medium 108 without the use of donor ribbons. The printer 101 can print these images by activating two or more color-forming layers within the output medium 108 at least partially independently by heating a single surface so that each color can be printed alone or in selectable proportion with the other colors.

Figure 2:
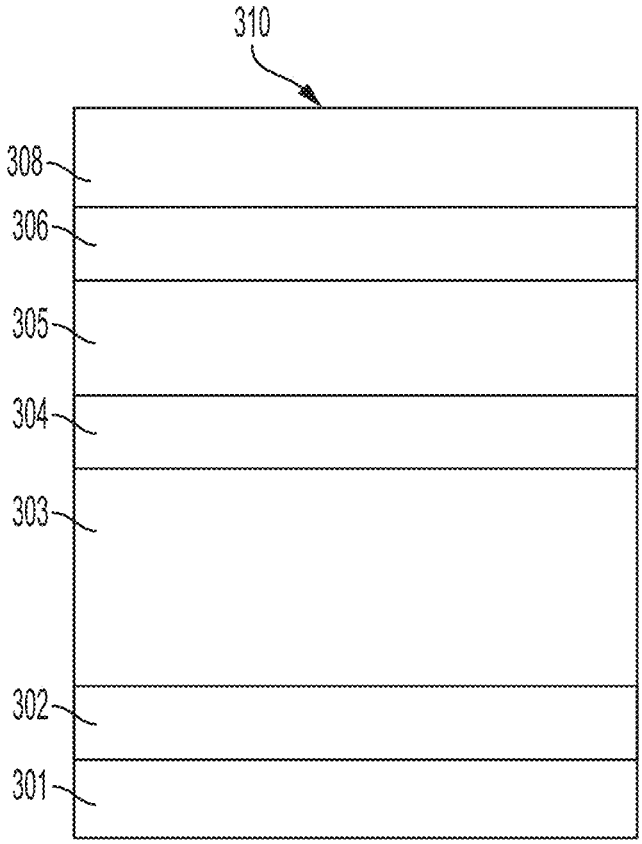
FIG. 2 is a diagram of an exemplary output medium.

In more detail, FIG. 2 is a schematic representation of the structure of the output medium 108 in a multicolor direct thermal printer. One surface of this medium carries three color-forming layers 302, 304, and 306, each capable of forming a different color when heated above a respective threshold temperature T1, T2 and T3. The three color-forming layers, 302, 304, and 306, are separated by chemically inert spacing layers 303 and 305. Layer 306 is furthermore covered by an overcoat 308 that may be designed to provide protection from scratches, UV light, chemicals and the like. Printing is mediated by electrically activated print head heating elements contacting surface 310 of the output medium.

The timing of the uniform electrical pulses applied to a print head element in each time segment determines the average electrical power applied to the print head element and is used to select a particular one of the image-forming layers embedded in the output medium 108. The average electrical power can therefore select which color to print.

The application of electrical pulses with relatively high average electrical power (i.e., closely-spaced pulses) for a limited time to a print head element in contact with surface 310 of the output medium can result in the formation of color in color-forming layer 306 without affecting color-forming layers 302 and 304. At the other extreme, the application of electrical pulses with low average electrical power (i.e., widely spaced pulses) can form color in color-forming layer 302 without affecting color-forming layers 304 or 306. The formation of color in the intermediate color-forming layer 304 can be accomplished by thermal pulses with an intermediate value of the average electrical power, provided that spacing layers 303 and 305 are chosen properly.

With an average power level selected for forming color in a chosen one of the color-forming layers, the optical density of the dots formed in that layer is controlled by the length of time that the print head element continues to supply the thermal pulses. Pulse streams with shorter duration produce dots that are smaller or of lower optical density and are perceived as lighter, while longer duration pulse streams produce dots that are larger or of higher optical density and are perceived as darker.

No mention has been made about the color formed by each of the individual color-forming layers. This printing method is absorptive in nature. It forms images by absorbing color from light reflected from a white substrate, or from light transmitted through a clear substrate. The preferred choice of colors for the color layers are yellow (Y), magenta (M) and cyan (C) because these colors correspond, respectively, to the absorption of the primary colors blue, green and red from light that is initially white.

When using this set of Y, M and C color formers, there remains a choice of layers in which to place them. There are three color-forming layers, denoted as "top" (for the layer 306 closest to the heated surface of medium), "middle" (for the second-most in depth, layer 304) and "bottom" (for the layer 302 furthest from the surface). The first successful embodiment of a medium of this type was one in which the top layer was yellow (Y), the middle layer was magenta (M), and the bottom layer was cyan (C). This structure is referred to as having "YMC" color order. In principle, it would be equally possible to envision media with YCM, CYM, MYC, CMY or MCY color order. It would seem that these structures would all give similar color performance, since the three layers are independently addressable. However, this question has not been addressed experimentally until recently because of the difficulty in finding components from which media with the alternate color orders may be fabricated.

One impediment has been the development of alternate dyes for use in the top-most layer 306. As described above, the formation of color in this layer is accomplished by applying a relatively high power for a very short time. For this to succeed, it is necessary to have a color-former with a very short time-constant for color formation.

The dyes used in this system are "amorphochromic." The amorphochromic dyes have one color when they are in crystalline form, and another color when they are in amorphous form. For the purposes of making a full-color direct-thermal print, the crystalline form of the dyes should be colorless, and for most applications the amorphous form should be cyan, magenta or yellow. The transition from crystalline to amorphous form may be induced, for example, by melting the crystals or by dissolving them in a solvent.

For the short time-constant required by layer 306, it is preferable that the color be formed directly by melting without the additional time required for dissolution in a solvent. This requires that the dye has not only the right color but also the right melting temperature, and such a combination is often difficult to find.

The present invention provides a novel media with the structure of CMY color order, which was compared with the standard YMC order media. It has been discovered that significant differences in image quality resulted from this change in the ordering of the color layers. The image sharpness and print uniformity were both significantly improved. This improvement applies to essentially all yellow, magenta and cyan dyes that can be made into compositions with the right melting temperatures. Examples of dyes useful in the media of the present invention include the yellow dyes numbered F-1 to F-12, described in U.S. Pat. No. 8,372,782, the magenta dyes numbered 1-47 in U.S. Pat. No. 7,807,607, and the cyan dyes numbered I to X in U.S. Pat. No. 7,704,667.

The '660 patent describes a method for producing full-color direct thermal prints in a single pass beneath a conventional thermal print head. The media is composed of multiple layers, normally coated on a white plastic substrate. The first layer is a sub-coat, chosen to improve adhesion of subsequent layers to the substrate, and to discourage the flow of oxygen molecules into the structure through the substrate.

Following this layer are a group of three color-forming layers, usually yellow, magenta and cyan in color, and in an order that must be chosen by the designer. The color-forming layers are separated by inert spacing layers designed to control the rate of thermal diffusion from the heated surface of the medium to the individual color-forming layers. In addition, at each interface between a color-forming layer and a spacing layer, there may be placed a thin barrier layer with the purpose of preventing the chemical diffusion of chemical components between the layers. The presence or absence of a barrier layer at these interfaces is determined by the chemical diffusion rates and the interactivity of the chemicals involved. Provided that chemical compositions can be found that are sufficiently stable, or that do not influence the stability of the colored images that are formed, it may be possible to eliminate one or more of the barrier layers and thereby simplify the structure.

Above the top color-forming layer, and closest to the heated surface of the medium, are one or more thin layers whose function is to protect the media from abrasion (e.g., from the sliding contact with the print head) and chemical incursion (e.g., water, fingerprints, oxygen), and to filter out ultraviolet light that may degrade the color of the dye layers.

The medium is used by applying heat to the surface, normally with a conventional thermal print head. This print head includes a linear array of closely spaced heating elements that may be individually activated electrically to apply an image-wise pattern of heat pulses to the media. Because of the time delays in the diffusion of heat from the heating elements on the surface to the color-forming layers, and because of the different melting temperatures of the three color-forming compositions, the color that is formed at each location on the media can be selected as the medium passes over the thermal print head. Print head elements that apply a relatively high power for a short time produce color in the color-forming layer 306 that is closest to the surface. Print head elements that apply a sufficient but lower power over a long time produce color in the color-forming layer 302 that is closest to the substrate. The middle color-forming layer 304 is activated by pulses of an intermediate power level applied for an intermediate length of time. By cyclically changing the pulsing of each print head element between these three types of pulsing, it is possible to choose, nearly independently, the amount of cyan, magenta and yellow color that are produced at each location on the print.

One would suppose that the choice of which dyes, Y, M or C, were to be used in the color layers 306, 304 and 302, would be governed solely by the practical issues of in finding a suitable set of color-forming compositions that have appropriate absorption spectra, form colors at the correct temperatures, and can form stable images when combined into a multi-layer structure with appropriate barrier layers and protective layers. Such considerations have been largely responsible for the composition of the current commercialized form of the media, which has the color order Y, M, C in the top, middle and bottom color layers, respectively. However, the present invention provides alternative color orders that can produce images of higher image quality.

The differences in image quality result from differences in the type of printing that occurs in each color-forming layer, depending on its distance from the heated surface. In particular, there is a distinction between "variable dot" and "variable density" printing. As we have discussed, three different power levels can be applied to the print head pixels such that they will preferentially print on the top, middle or bottom color-forming layer. At each of these power levels, the optical density of the color that is formed can generally be varied by applying the power for a shorter or longer time. For example, it is possible to choose a power level that preferentially produces color in the top color-forming layer when applied for a short time. Within the scope of this short time there is a range of times varying from 0, at which no top-layer color is formed, to a maximum value tmax at which a maximum amount of the top-layer color is formed. Applying the chosen power level for a time longer that this tmax may begin producing color in one of the other color-forming layers and compromising the purity of the top-layer color.

The manner in which the color density changes between these extremes determines whether the printing falls in the category of variable-dot, variable-density, or a mix of the two. In the case of variable-dot printing, color is formed initially as a small dot of maximum optical density $D_{max}$ in the center of the pixel. As the pulsing time is increased, the dot grows in size until it fills the entire pixel (and perhaps even produces some color in neighboring pixels). In the case of variable-density printing, color is formed essentially uniformly over each pixel, and the optical density changes as a result of a uniform increase in density from 0 to $D_{max}$ across the entire pixel as time proceeds.

Figure 3A:
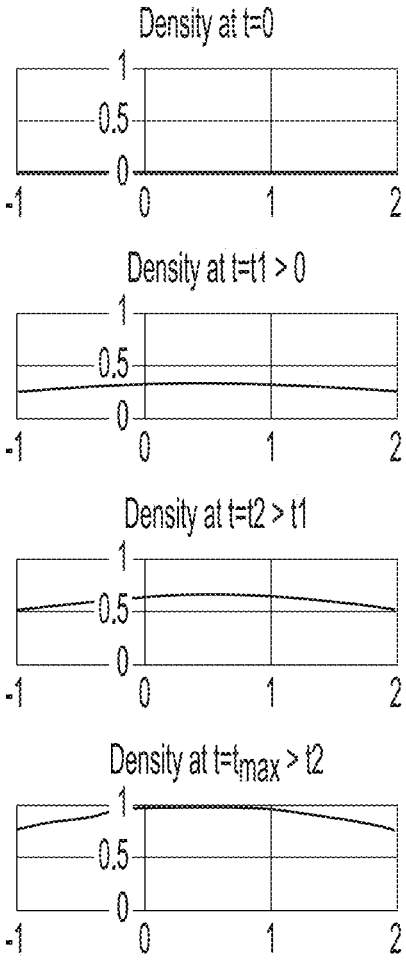
FIG. 3A illustrates the variable-density process in which color is produced uniformly in the pixel but varies gradually in optical density as the exposure time increases from $t=0$ to $t=t_{max}$.
Figure 3B:
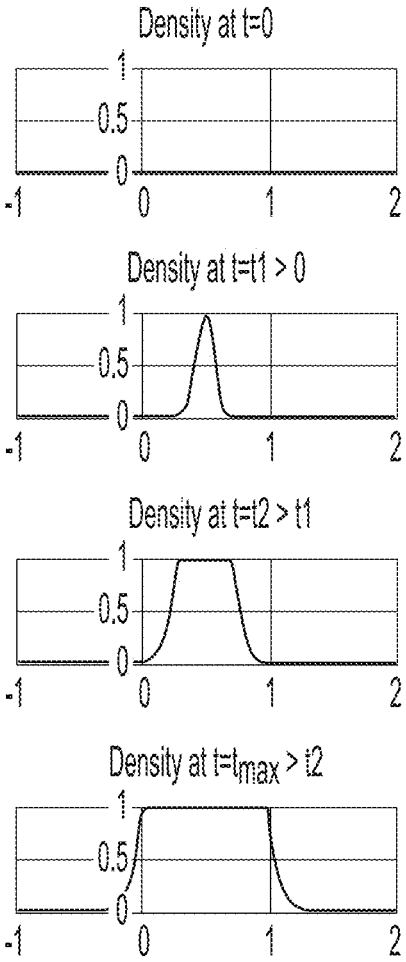
FIG. 3B illustrates the variable-dot process, in which color of maximum optical density is initially formed as a small dot, much smaller than the pixel dimension, and then increases in size until it fills the pixel as the exposure time increases.

These two extremes of the color formation process are illustrated schematically in FIG. 3. FIG. 3A illustrates the variable-density process in which color is produced uniformly in the pixel but varies gradually in optical density as the exposure time increases from $t=0$ to $t=t_{max}$. FIG. 3B illustrates the variable-dot process, in which color of maximum optical density is initially formed as a small dot, much smaller than the pixel dimension, and then increases in size until it fills the pixel as the exposure time increases. Intermediate cases are also possible, in which the color formation originally forms a non-uniform dot of less than maximum density that subsequently increases in both size and density. In all cases, the optical density of the color begins at zero and rises to a similar maximum value, but the fashion in which it does so, and the image quality that results are different.

The reason for describing these two types of color formation is that each of the color-forming layers in the direct-thermal full color printing system exhibits a different form of color production. This results from the lateral spreading of heat that occurs as the heat travels in the media from the print head heating elements to the buried color-forming layers.

The heating element itself has a temperature profile that is generally highest near the center of the heater and drops in all directions away from this center. The color-forming compositions, however, operate by converting crystalline amorphochromic dye to amorphous form, either by direct melting of the dye crystals themselves, or by the melting of a crystalline thermal solvent that subsequently dissolves the crystalline dye to form an amorphous mixture that hardens on cooling. The physical process that results in color formation is, in either case, a melting transition having a temperature width that is typically 10-20° C. When the dye composition is brought into contact with the heating element, therefore, the central portion of the heater that is above the melting temperature of the dye or thermal solvent (whichever is lower) cause a transition to the colored amorphous form of the dye, while the outer portions of the heater, which are still below the melting temperature, leave the color-forming composition in its colorless state. Provided that the central part of the heater is above the melting temperature, this results in a colored spot in the media at the center of the pixel, surrounded by a clear region around it where the melting temperature has not been exceeded. If the temperature of the heater is increased by applying additional energy, then a larger fraction of the pixel becomes colored and a smaller fraction remains colorless. When a sufficient amount of energy has been applied, the entire pixel will be above the melting temperature, and the pixel will be fully colored.

The process just described is a case of variable-dot printing, insofar as it begins with a small colored dot forming near the center of the pixel, and then continues with a growth in the size of that dot as the printing energy increases. It is characteristic of the case in which the color-forming layer is in direct contact with, or very near to, the heating element. In particular, it is characteristic of the top-most color-forming layer 306 of the full color direct thermal medium, which is quite close to the heating element. It is not characteristic, however, of the bottom-most color-forming layer.

In the description of the media given above, it has been described that there are several layers in between the heated surface of the media and the bottom color-forming layer. Most importantly, these layers include two inert interlayers, one between the top and middle color-forming layers, and the other between the middle and bottom color-forming layers. These two inert layers comprise a large fraction of the total thickness of the layers coated on the substrate and may have a combined thickness of approximately 40 microns. As heat travels from a print head heating element to the bottom color-forming layer, through these relatively thick intermediate layers, it diffuses laterally as well as downward. In doing so, the lateral temperature profile becomes wider and overlaps between adjacent pixels. This generally leads to a temperature profile that is less sharp and has a smaller range of temperature variation over each pixel than is observed in the top color-forming layer. In fact, it is not uncommon to have difficulty discerning a variation in optical density from the center to the edge of each pixel in the bottom color-forming layer without careful measurements. This spreading of the temperature profile results in printing that is more accurately characterized as variable density. That is, it exhibits a more uniform density over the entire pixel, with an optical density that increases uniformly as the printing energy increases and passes through the melting transition temperature range of the color-forming composition. The spreading of heat also extends into neighboring pixels, such that the optical density of each pixel is not only a function of the energy applied to the heating element of that very pixel, but also of the energy supplied to the neighboring heating elements (or pixels) on either side. This results in a reduction of the sharpness of images printed in the bottom color-forming layer as compared to the top color-forming layer.

The middle color-forming layer, as may be imagined, has characteristics that are between variable dot and variable density printing. On the one hand, it is easily discerned that the optical density of the color is not uniform over each pixel, having a density that is noticeably higher in the center of each pixel and lower near the edges. On the other hand, the coloration is not so confined that it has the form of a distinct colored dot surrounded by a colorless border.

In summary, the printing in each of the color-forming layers is distinguished by various degrees of sharpness depending upon the distance of the layer from the heated surface of the media. The top color-forming layer, closest to the heating element, has sharp, well-resolved dots. The middle color-forming layer has dots that are distinguishable from pixel to pixel, but which extend somewhat into neighboring pixels. The bottom color-forming layer has dots that are difficult to discern, with so much overlap of heating between adjacent pixels that there is very little resolution between adjacent pixels.

The loss of resolution in the layers that are deeper in the media results in a lessened sharpness of images as perceived by viewers. However, the loss of sharpness perceived by a human observer depends not only on the heat profile changes at buried layers 302 and 304, but also upon the ability of the observer's eyes to detect the changes in density that they cause. The human visual system has a resolving power that is highly color dependent, so the contribution of each color layer to the overall perception of sharpness must be weighted by the ability of the human eye to resolve features in an image with the color of that layer.

The human perception of sharpness is determined primarily by the spatial frequency content of the luminance component of light reflected from the printed image. According to standard IEC 61966-2-1:1999 of the International Electrotechnical Commission, the luminance (Y') may be determined from the red, green and blue (R,G,B) contributions of the light through the following formula:

$$Y'=0.2126*R+0.7152*G+0.0722*B$$

In the case of the direct thermal media at hand, the color layers are labeled with the colors C, M and Y. These colors are associated with the generation of red-absorbing, green-absorbing and blue-absorbing dyes, to which the weighting factors in this formula apply.

Using the standard conversion from Red, Green and Blue to Cyan, Magenta and Yellow (C=1-R, M=1-G, Y=1-B), we can express this luminance in terms of C, M, and Y as the following:

$$Y'=1-0.2126*C+0.7152*M+0.0722*Y$$

While this would be exact only for dyes which matched the IEC specification, it is true that in general, any dye that is reasonably called "yellow" will have the lowest effect on luminance, and any dye that is reasonably called "magenta" will have the highest effect on luminance, though the exact ratios may vary slightly.

The formula may therefore be interpreted as indicating that the cyan layer has a 21% contribution to the perceived sharpness, the magenta layer has a 72% contribution, and the yellow layer has a 7% contribution.

The most notable feature of this result is that while the yellow layer affects the color of an image, it makes very little contribution to the perceived sharpness of an image. In fact, when the yellow content of an image is printed in isolation, the resulting image is extremely indistinct and offers only a very 'fuzzy' view of the image content. Printing the magenta content of the image in isolation, on the other hand, provides a rendition that accounts for over 70% of the sharpness.

The dependence of the luminance Y' on the R, G and B is good evidence that the yellow layer is the least important to the perception of sharpness. From this observation, it was concluded that the yellow dye should therefore be situated in the layer where the pixels produce the lowest-resolution image; namely, in layer 302 which is furthest from the heated surface.

The present invention provides a medium with the cyan color on top, magenta in the middle and yellow on the bottom (CMY), providing a higher level of sharpness than that of the current media with color order YMC. Apart from the strong dependence on color, the sensitivity of the human eye to changes in density is also a function of the spatial frequency of these changes. The human eye has color sensors (known as 'cones') laid out in the fovea with a certain number per unit area. The discreteness of these sensors establishes a certain maximum resolution of which the eye is capable, so there is, in effect, a ceiling to the perceived sharpness. Above a spatial frequency of about 2 cycles/mm (when viewed from a standard viewing distance of 18") the improved reproduction of sharp features of the image becomes more and more offset by a lessened ability of the eye to appreciate the improvements. It is also true that a drop-off in sensitivity in the human visual system occurs for spatial frequencies below about 0.5 cycles/mm as a result of the fashion in which the signals from the individual visual sensors are combined. These facts are embodied in a quantity called the "contrast sensitivity function", or CSF, which is a function of spatial frequency that peaks at about 1 cycle/mm and drops at both lower and higher spatial frequencies.

To be more precise about the effects of the CSF, it is possible to evaluate a quantity named SQF (subjective quality factor), which has been found in human testing to correlate very well with the perception of sharpness. The formal procedure for evaluating SQF is the following. Starting with an image composed of many squares, such as those shown in FIG. 4, each having a uniform optical density, the densities of the squares are distributed in a fashion that provides samples of sharp edges between them at a wide variety of different average luminance. This image is printed on the media under test to provide samples of the transitions between the squares as reproduced on the media. The printed sample is then scanned on a high-resolution flat-bed scanner. The edges between squares of different density are identified in these images and are analyzed to provide line graphs of the optical density transitions that take place across the edges. Samples are shown for two media structures, designated Z2.5 (YMC) and Z3.0 (CMY), in FIG. 5.

To evaluate the sharpness of these transitions, the modulation transfer function (MTF) is computed, which is well-known to those skilled in the art. This MTF separates the density-vs-position graphs into components of different spatial frequency f. Since the human eye is not equally sensitive to all of these frequencies, the MTF is multiplied by the CSF to arrive at a representation of the edge data as perceived by the human eye.

Figure 6:
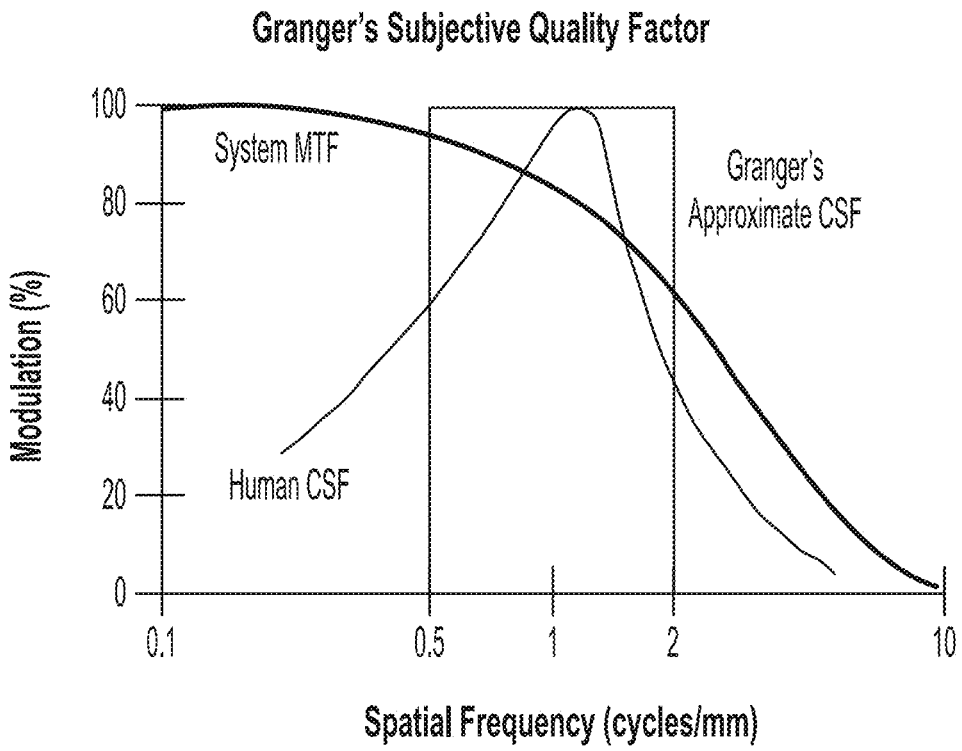
FIG. 6 is a line graph illustrating the approximate contrast sensitivity function using the Granger simplification.

In actual fact, a simplification due to E. M. Granger is used which approximates the CSF as simply a "window" in spatial frequency, which has a value of 1.0 for spatial frequencies between 0.5 and 2 cycles/mm, and a value of 0.0 at all other spatial frequencies. Values of SQF calculated with this simplified approximation to the actual CSF have also been verified in human testing to correlate closely with their ratings of perceived sharpness. With this simplification, the result of the CSF is simply to restrict our consideration of spatial frequency to the range of 0.5 to 2 cycles/mm. See FIG. 6. The MTF is consequently integrated over spatial frequency from 0.5-2 cycles/mm to arrive at the SQF. The integration is performed on a logarithmic frequency axis, which introduces a factor of 1/f and the SQF is normalized to fall on a scale of 0-100 through the use of a scaling factor K.

$$SQF = K\int_{0.5}^{2}\frac{MTF(f)}{f}df \text{ where } K = 100\Big/\int_{0.5}^{2}\frac{1}{f}df$$

To appreciate the meaning of SQF as a measure of subjective sharpness, it is helpful to refer to the following table, which is the result of scaling tests with observers, using test images that have been artificially modified to have different SQF.

| SQF | Visual Description |
|---|---|
| >92 | Excellent |
| 85-92 | Very Good |
| 75-84 | Good |
| 56-74 | Acceptable |
| 43-55 | Unsatisfactory |
| 30-42 | Poor |
| <30 | Unusable |

Figure 13:
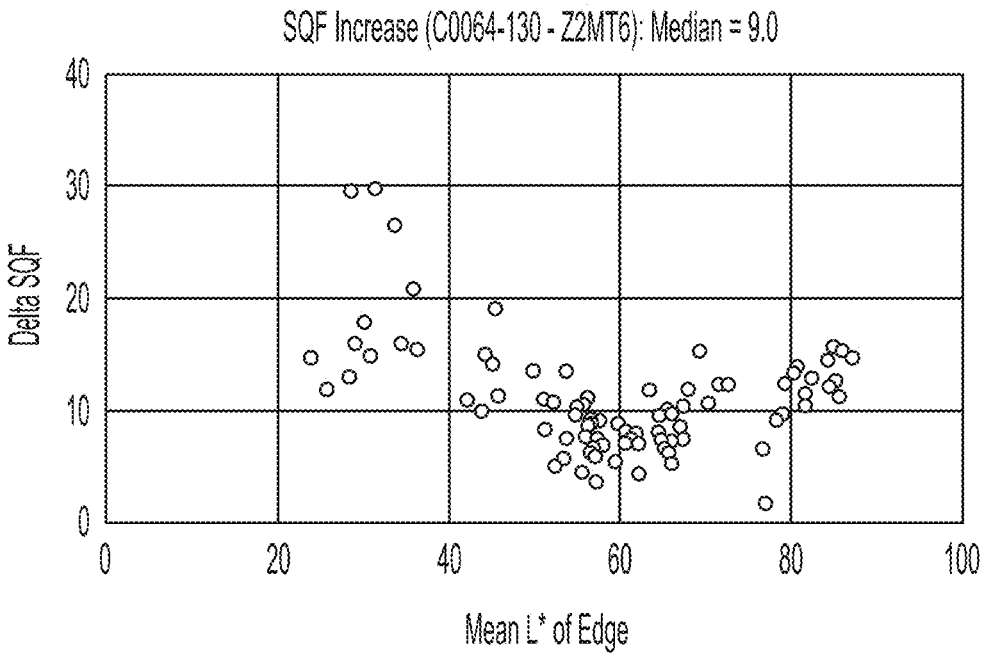
FIG. 13 illustrates the increase in SQF that results from a change in the color order of the dye layers from YMC to CMY in the "upside-down" C0064-130 structure.

As illustrated in FIG. 13 (and as explained in greater detail in the Examples section below), an improvement in SQF resulted from a change in the color order of the dye layers from YMC to CMY. In this figure, the notation Z2MT6 refers to a prior art media sample with YMC color order. The notation C0064-130 refers to an example novel media with CMY color order that implements the current invention. The SQF itself is a sharpness measure whose value may depend on the luminance of the image around the edge for which it is being evaluated. Therefore, the measured improvement in SQF was plotted against the mean of the luminance on the two sides of the edge. The median SQF changed from 65 to 74. Particularly in the low and high ends of the luminance range, the subjective sharpness improved by a very significant 10-15 points.

Another benefit in image quality that resulted from the new color order for the dye layers was one of image uniformity. Non-uniformity of the image is most apparent in regions of an image that are meant to be constant in color and luminance, or to be changing gradually in these quantities. An example is the printing of labels, for which the background color is often chosen to be a fixed, solid color. Other examples are images with blue skies that change only gradually in color, or human faces with nearly constant skin tones. Such images may be seriously degraded by even small variations in color or luminance that arise from imperfection in the printer or media.

There are two sources that account for most uniformity problems in direct thermal printing. The first relates to variations in the rate of transport of the medium past the print head heating elements. As has been described in previous patents, the color and density of printing at each point on the direct thermal print depend upon the power and energy delivered at that point by a print head element. The power is primarily responsible for selecting the color layer in which printing occurs, and the energy affects the density of printing in that layer. Each of these quantities, however, is measured on a "per-unit-area" basis. It is the "energy per unit area" and "power delivered per unit area" that are the relevant quantities for achieving uniform printing. Therefore, uniformity may be upset by variations in the transport velocity, which change the area per unit time that passes the print head elements. The transport of the media is usually accomplished by a stepping motor followed by a train of gears to reduce the high-speed/low-torque drive of the motor to the low-speed/high-torque motion necessary to propel the medium. Both the stepping motor and the individual gears in the gear train inevitably have small imperfections that lead to periodic excursions in speed that show up as bands in color or luminance. While such banding may often be very limited and disguised by the variety of color and luminance variations that normally appear in an image, it can become noticeable in regions of the print having constant or near-constant color and illumination.

A second common source of non-uniformity is variations in the media itself. It is customary to speak of the layers of the medium as if they were each of precisely uniform thickness and composition, but this is not so in practice. The layers are formed by coating liquids with suspensions of crystalline dyes, thermal solvents and other additives. Although thoroughly mixed to achieve uniform distribution, these constituents are nevertheless subject to fluctuations in distribution that may lead to variations in properties from point to point. Moreover, the liquids are coated in a multiple-layer-at-a-time coating process in which the individual liquid layers are first stacked into a layered fluid, then poured onto the substrate and dried. The process is carried out under laminar-flow conditions, but there is still opportunity in the coating and drying process for local variation in layer thickness or composition to occur. Hence, the final medium may have a distribution of small regions having slight variations in color or luminance when printed.

These sources of non-uniformity tend to act disproportionately on the color layer 302 that is most distant from the heated surface of the medium. This fact may be traced to the fact that printing on this layer is closest to being variable density printing, while in layers 306, closest to the heated surface, the printing is more nearly variable-dot printing. What this means in practice is that the exposure for layer 302 will generally have a response curve (printed optical density vs log of applied energy) that is steeper. To see why this is so, consider this schematic representation.

As discussed earlier, the temperature profile of a print head heating element is typically a narrow and peaked function when measured close to the element. The temperature is highest in the center and falls off towards the edges of the pixel. The temperature profile at nearby color layer 306 is nearly the same. Layer 306 will therefore begin colorizing first in the center of each pixel. Then, as additional energy is applied to the heating element, the temperature will continue to rise and more of the pixel will rise above the threshold temperature at which colorization occurs. Finally, when the temperature at the center of the pixel is high enough, even the edges of the pixel will be above the threshold colorization temperature and the pixel will have reached its maximum optical density.

Figure 7:
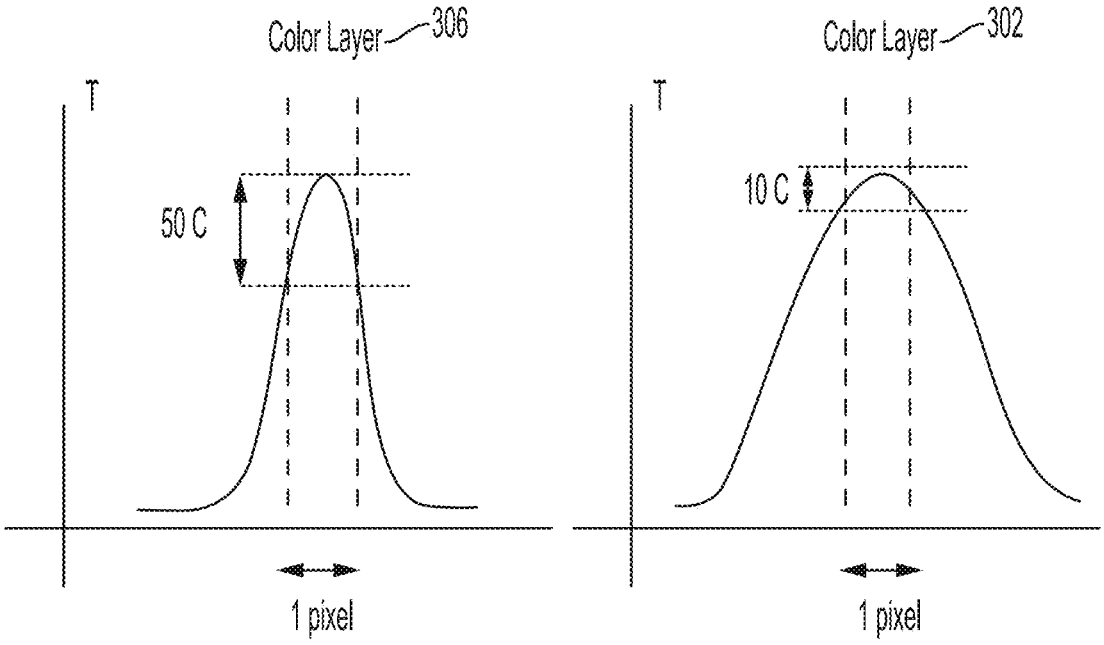
FIG. 7 depicts schematic temperature profiles in two layers of the media when a heating element of the print head is pressed against the media surface.

For example, consider the hypothetical example in FIG. 7, which shows a schematic temperature profile of a heating element of the print head when it is pressed against the media surface. The left side of the figure illustrates the case in which a certain amount energy E0 has been applied to the element. The center of the pixel has heated up from the ambient starting temperature of 25° C. and has just reached the threshold temperature for coloration, which is taken to be 200° C. At this point the temperature at the edges of the pixel may be, e.g., 150° C. After the application of additional energy dE, the central temperature has considerably passed the threshold temperature—so much so that now even the edges of the pixel are at the threshold temperature. This additional temperature is 50° C. and may therefore require and additional 50/(200-25)=29% in energy. Accordingly, the change from initial colorization to maximum density occurs over an energy range of E0 to 1.29 E0, and the slope of the exposure curve (which is conventionally written as a function of log(E)) would be approximately:

$$\frac{dD}{d(\log(E))} \approx \frac{D_{\{max\}}}{\log(1.29)} = 9 * D_{\{max\}}$$

The same type of rough estimate can be applied to layer 302 that is furthest from the surface. In this case, considerable thermal diffusion takes place as the heat travels from the heating to layer 302. Now the thermal profile of the heat is wider, so that the temperature between the center and edge of the pixel may be just 10° C. rather than 50° C. This new value is just comparable to the width of the melting curve of the dye crystals and therefore represents the minimum range of temperatures over which colorization might occur. As illustrated in the right side of the figure, the exposure begins when a certain amount of energy E1 has been applied to the heating element and the center of the pixel has just reached the threshold temperature of layer 302, which is taken to be 100° C. At this point the temperature at the edges of the pixel may be 90° C. After the application of additional energy dE, the central temperature has passed the threshold temperature so that the edges of the pixel have reached the threshold temperature as well. This additional temperature rise is 10° C. and may therefore require and additional 10/(100-25) =13% in energy. Therefore, the change from initial colorization to maximum density occurs over an energy range of E1 to 1.13 E1, and the slope of the exposure curve will be approximately:

$$\frac{dD}{d(\log(E))} \approx \frac{D_{\{max\}}}{\log(1.13)} = 19 * D_{\{max\}}$$

This illustrative example provides an explanation for a phenomenon that is observed in practice. Namely, it is observed that the color layers more distant from the heated surface, as a result of the lateral spreading of the heating profile, exhibit exposure curves with steeper slopes. As a consequence, any imperfections that cause variations in the energy reaching these layers produce larger variations in density in the more deeply buried dye layers 302 and 304 than in dye layer 302 near the heated surface.

For example, variations in the speed of transport of the media past the thermal print head leads to variations in the energy per unit area deposited by the heating element at the surface of the media. As this heat diffuses into the media, the variation leads to a change in optical density of each of the three-color layers. However, the change in density that is caused is larger for the layers more distant from the surface because of the inherently higher slope of their exposure curves.

Likewise, local fluctuations in the composition or thickness of the coated layers of the structure may cause variations in the energy reaching each point of the dye layers beneath them. The fluctuations in optical density of the dye layers caused by these variations is larger for more deeply buried dye layers.

Some embodiments of the technology described herein can be defined according to any of the following numbered paragraphs:

1. A multicolor direct thermal printer output medium comprising:
   a surface; and
   three separate color-forming layers capable of forming the colors cyan (C), magenta (M) and yellow (Y) and comprising a top, middle, and bottom color-forming layer, wherein the yellow color former is the bottom color-forming layer.
2. The multicolor direct thermal printer output medium of claim 1, further comprising:
   a first inert layer between the top and middle color-forming layers; and
   a second inert layer between the middle and bottom color-forming layers.
3. The multicolor direct thermal printer output medium of any one of claim 1 or 2,
   wherein the cyan color former is the top color-forming layer and the magenta color former is the middle color-forming layer
4. A multicolor direct thermal printer output medium comprising:
   a surface;
   a top color-forming layer of cyan (C);
   a middle color-forming layer of magenta (M); and
   a bottom color-forming layer of yellow (Y).
5. The multicolor direct thermal printer output medium of claim 4, further comprising:
   a first inert layer between the top and middle color-forming layers; and
   a second inert layer between the middle and bottom color-forming layers.
6. A multicolor direct thermal printing system comprising:
   a multicolor direct thermal printer comprising one or more print heads, each of the one or more print heads containing a linear array of heating elements; and
   an output medium, the output medium transported past the print head elements to produce a two-dimensional image, the output medium comprising:
   a surface;
   a top color-forming layer of cyan (C);
   a middle color-forming layer of magenta (M);
   a bottom color-forming layer of yellow (Y);
   a first inert layer between the top and middle color-forming layers; and
   a second inert layer between the middle and bottom color-forming layers.
7. A method of improving the image sharpness of a multicolor direct thermal printer output comprising using an output medium with a structure of color order of:
   a top color-forming layer of cyan (C);
   a middle color-forming layer of magenta (M); and
   a bottom color-forming layer of yellow (Y).
8. The method of claim 7, wherein the multicolor direct thermal printer output uses the output medium of any one of claims 1-5.
9. A method of improving the print uniformity of a multicolor direct thermal printer output comprising using an output medium with a structure of color order of:
   a top color-forming layer of cyan (C);
   a middle color-forming layer of magenta (M); and
   a bottom color-forming layer of yellow (Y).
10. The method of claim 9, wherein the multicolor direct thermal printer output uses the output medium of any one of claims 1-5.

The description of embodiments of the disclosure is not intended to be exhaustive or to limit the disclosure to the precise form disclosed. While specific embodiments of, and examples for, the disclosure are described herein for illustrative purposes, various equivalent modifications are possible within the scope of the disclosure, as those skilled in the relevant art will recognize. For example, while method steps or functions are presented in a given order, alternative embodiments may perform functions in a different order, or functions may be performed substantially concurrently. The teachings of the disclosure provided herein can be applied to other procedures or methods as appropriate. The various embodiments described herein can be combined to provide further embodiments. Aspects of the disclosure can be modified, if necessary, to employ the compositions, functions and concepts of the above references and application to provide yet further embodiments of the disclosure. Moreover, due to biological functional equivalency considerations, some changes can be made in protein structure without affecting the biological or chemical action in kind or amount. These and other changes can be made to the disclosure in light of the detailed description. All such modifications are intended to be included within the scope of the appended claims.

Specific elements of any of the foregoing embodiments can be combined or substituted for elements in other embodiments. Furthermore, while advantages associated with certain embodiments of the disclosure have been described in the context of these embodiments, other embodiments may also exhibit such advantages, and not all embodiments need necessarily exhibit such advantages to fall within the scope of the disclosure.

The technology described herein is further illustrated by the following examples which in no way should be construed as being further limiting. Although methods and materials similar or equivalent to those described herein can be used in the practice or testing of this disclosure, suitable methods and materials are described below.

EXAMPLES

The invention now being generally described, it will be more readily understood by reference to the following examples which are included merely for purposes of illustration of certain aspects and embodiments of the present invention and are not intended to limit the invention.

Example 1 Comparison of the Conventional YMC Media with the "Upside-Down" CMY Media The property of direct thermal media is evidenced in the following quantitative comparison. Two sample media were fabricated, using similar methods, but with different dye compositions. The first, identified as Z2MT6 is the conventional media, having a yellow layer closest to the surface, and with magenta and then cyan layers sequentially more distant from the surface (i.e., YMC color order). The layer structure and compositions of this media have been disclosed previously in, for example, the '660 patent, and the media itself is available commercially under the ZINK brand name. The second sample, identified as C0064-130, is a new structure having the locations of the yellow and cyan layers transposed and the compositions of these layers changed to achieve the appropriate thermal activation temperatures.

Figure 8:
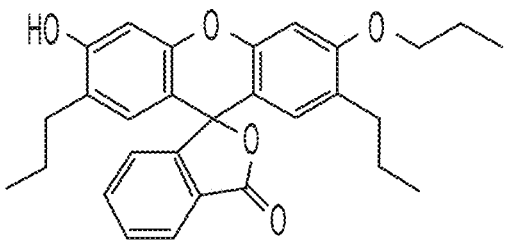
FIG. 8 provides the chemical structures of some of the components of the yellow layer of the "upside-down" C0064-130 media (CMY), namely the yellow dye, ID1226 (FIG. 8*a*), the thermal solvent, TS425 (FIG. 8*b*), and the acid developer, AD128 (FIG. 8*c*).
Figure 8:
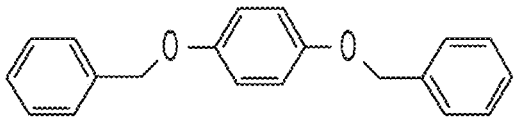
Figure 8:
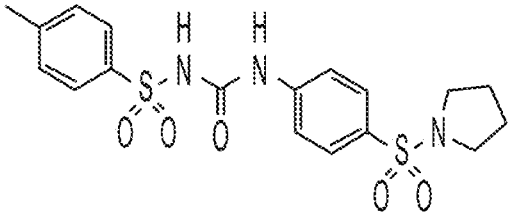

In particular, yellow layer 302 of C0064-130 used a dye with the structure shown in FIG. 8*a*, which is referred to herein as ID1226. Its systematic name is [3'-hydroxy-6'-propyloxy-2',7'-dipropyl fluoran]. It was combined with a thermal solvent having the structure shown in FIG. 8*b*, referred to herein as TS425. This compound has CAS Registry Number 621-91-0, and its systematic name is 1,4-Di(benzyloxy)benzene. TS-425 is available from numerous commercial sources, including TCI America (Portland, Oreg.). The yellow layer also included an acid developer, referred to herein as AD128 and shown in FIG. 8*c*. Its systematic name is [4-methyl-N-[[[4-(1-pyrrolidinylsulfonyl)phenyl]amino]carbonyl]-benzenesulfonamide]. Its melting point is 173° C. The final coated density of yellow layer 302 was 5730 mg/m$^2$, and its composition, by weight percent, of the yellow layer was:

| | |
|---|---|
| TS425 | 29.80% |
| AD128 | 29.76% |
| PB6692MNA | 29.61% |
| Zonyl FSN | 0.26% |
| ID1226 | 10.56% |

The component PB6692MNA is a styrene/butadiene rubber latex with Tg 1-5° C. available from Dow Chemical Co. (Midland, Mich.). Zonyl FSN is a surfactant obtained from E. I. du Pont de Nemours (Wilmington, Del.).

Figure 9:
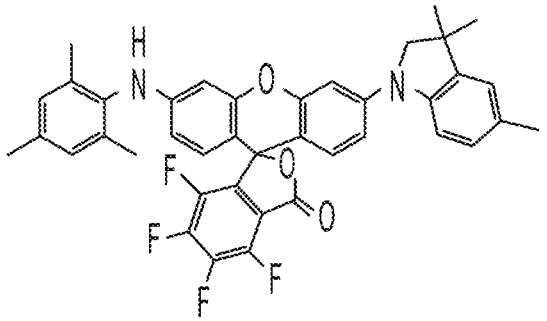
FIG. 9 provides the chemical structures of some of the components of the cyan layer of the "upside-down" C0064-130 media (CMY), namely the cyan dye, ID923 (FIG. 9*a*) and the thermal solvent, TS376 (FIG. 9*b*).
Figure 9:
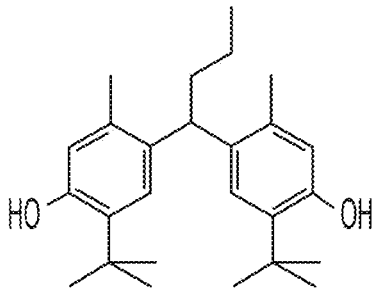

The cyan layer 306 used a dye with the structure shown in FIG. 9*a*, which is referred to herein as ID923. Its systematic name is [3'-(2,4,6-trimethylanilino)-6'-(3,3,5-trimethylindolino)-4,5,6,7-tetrafluoro fluoran].

This dye was mixed with a thermal solvent with the structure show in FIG. 9*b*, referred to herein as TS376. This thermal solvent has CAS Registry Number 85-60-9, and its systematic name is 4,4'-Butylidenebis(3-methyl-6-t-butylphenol. It is available from numerous commercial sources, including TCI America (Portland, Oreg.). The final coated thickness of cyan layer 306 was 1167 mg/m$^2$ and its composition, by weight % was:

| | |
|---|---|
| PVA540 | 33.75% |
| Zonyl FSN | 1.79% |
| TS376 | 38.75% |
| ID923 | 25.71% |

PVA540 is a poly-vinyl alcohol available from Sekisui Specialty Chemicals America (Dallas, Tex.). Zonyl FSN is a surfactant that was obtained from E.I. du Pont de Nemours (Wilmington, Del.).

Figure 10:
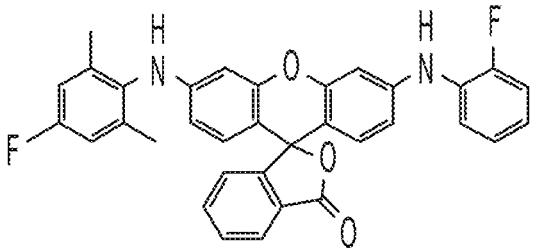
FIG. 10 provides the chemical structures of some of the components of the magenta layer of the "upside-down" C0064-130 media (CMY), namely the magenta dye, ID1036 (FIG. 10*a*), the thermal solvent, TS395 (FIG. 10*b*), and the thermal solvent, TS274 (FIG. 10*c*).
Figure 10:
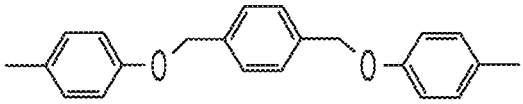
Figure 10:
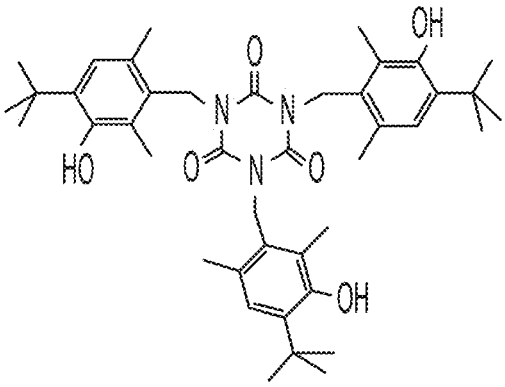

The magenta layer 304 in the CMY test structure was a mixture of a magenta dye, designated herein as ID1036, and three thermal solvents, named TS395, TS274 and TS376. The structure of magenta dye ID1036 is shown in FIG. 10*a*. This molecule has CAS Registry Number 1157876-23-7 and systematic name 3'-(2-fluoroanilino)-6'-(4-fluoro-2-methylanilino)fluoran, Magenta dye ID-1036 is compound 23 of U.S. Pat. No. 7,807,607. Thermal solvent TS395 has the structure shown in FIG. 10*b*. This thermal solvent has CAS Registry Number 10350-55-7 and systematic name 1,4-Bis[(4-methylphenoxy)methyl]benzene. Thermal solvent TS274 has the structure shown in FIG. 10*c*. It has CAS Registry Number 40601-76-1 and systematic name 1,3,5-Tri(4-tert-butyl-2,6-dimethyl-3-hydroxybenzyl)-1,3,5-triazine-2,4,6(1H,3H,5H)-trione. TS-274 is available from numerous commercial sources, including TCI Europe. Thermal solvent TS376 has the structure shown in FIG. 9*b* and was previously described as a component of cyan layer 306. The final coated weight of magenta layer 304 was 2560 mg/m$^2$ and its composition by % weight was:

| | |
|---|---|
| PVA540 | 20.25% |
| Zonyl FSN | 1.11% |
| ID1036 | 8.88% |
| TS395 | 46.46% |
| TS274 | 5.14% |
| TS376 | 18.15% |

In addition to the dye layers, the coating C0064-130 has two interlayers, 303 and 305, and an overcoat 308. Interlayer 303 has a coating weight of 15000 mg/m$^2$ and its composition by % weight was:

| | |
|---|---|
| PB6692MNA | 39.89% |
| CP655NA | 20.07% |
| Zonyl FSN | 0.64% |
| TS274 | 14.45% |
| MP103 PVA | 24.95% |

MP103 is a poly-vinyl alcohol supplied by Kuraray America, Inc. (Houston, Tex.). CP655NA was obtained from Dow Chemical Co. (Midland, Mich.). The remaining components have been described in connection with the dye layers.

Interlayer 305 has a coating weight of 3000 mg/m$^2$ and its composition by % weight was:

| | |
|---|---|
| PB6692MNA | 69.56% |
| Zonyl FSN | 0.97% |
| TS274 | 14.40% |
| Alkanol XC | 0.31% |
| MP103 PVA | 14.77% |

Alkonol XC is a surfactant obtained from E.I. du Pont de Nemours (Wilmington, Del.). The remaining components of interlayer 305 have been described previously.

The overcoat 308 has three sublayers. On top of the cyan layer 306, there is a barrier sublayer with a coating weight of 550 mg/m$^2$. Its composition, by % weight, was:

| | |
|---|---|
| PVA 325_10 | 89.49% |
| Zonyl FSN | 1.60% |
| Leucophor STR | 8.91% |

PVA 325_10 is a poly-vinyl alcohol available from Sekisui Specialty Chemicals America (Houston, Tex.). Leucophor STR is an optical brightener, from Archroma US (Greenville, S.C.).

Above the barrier sublayer is a UV-blocking layer with a coating weight of 2000 mg/m$^2$, whose composition by % weight is:

| | |
|---|---|
| MP103 PVA | 14.16% |
| Zonyl FSN | 0.79% |
| MS7 | 85.05% |

MS7 is a nanoparticulate grade of titanium dioxide U from Kobo Products Inc. (South Plainfield, N.J.).

Finally, on the top surface is a protective layer with a coating weight of 1000 mg/m$^2$, and a composition by % weight of:

| | |
|---|---|
| PVA 540_8 | 42.26% |
| Zonyl FSN | 2.10% |
| Hidorin F115P | 21.0% |
| Nalco 2327 | 34.65% |

PVA 540_8 is a poly-vinyl alcohol from Sekisui Specialty Chemicals America (Dallas, Tx). Hidorin F115P is a meltable lubricant from Nagase America Corp. (New York, N.Y.). Nalco 2327 is colloidal silica from Nalco Chemical Company (Naperville, Ill.).

Although the benefits of the current invention are exemplified by the particular media structure just described, it will also benefit direct thermal media manufactured with a broad variety of different dyes. For example, they will apply generally to media made with the dyes described in U.S. Pat. Nos. 8,372,782; 7,704,667; and 7,807,607.

In the sample just described, the cyan color layer was closest to the surface, while the magenta and then the yellow layers were sequentially more distant from the surface (i.e., CMY color order).

Results

Figure 11:
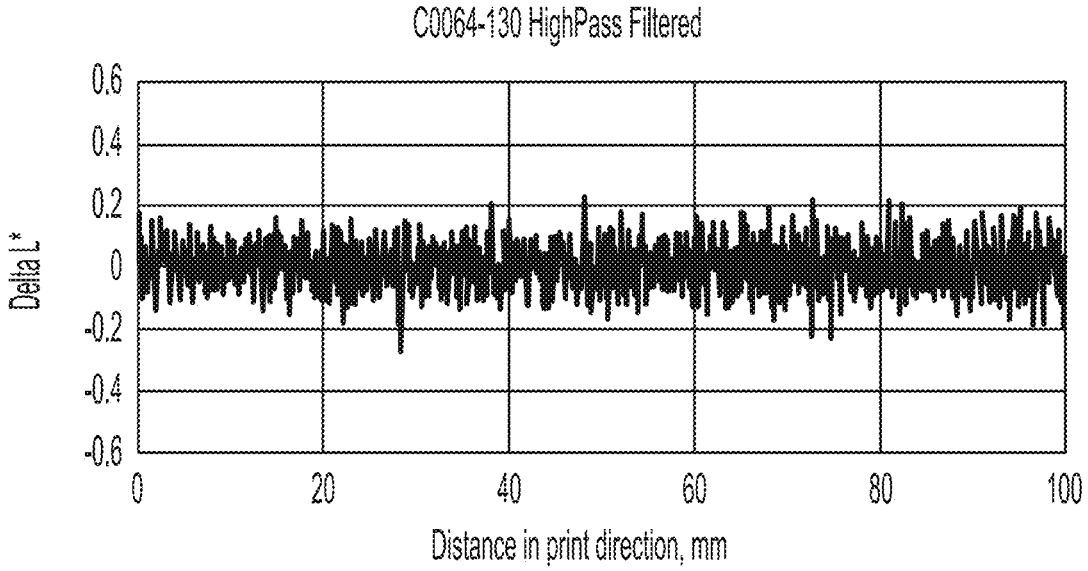
FIG. 11 provides a comparison of the high spatial frequency fluctuations in luminance between the conventional Z2MT6 structure (YMC) and the "upside-down" C0064-130 structure (CMY).
Figure 11:
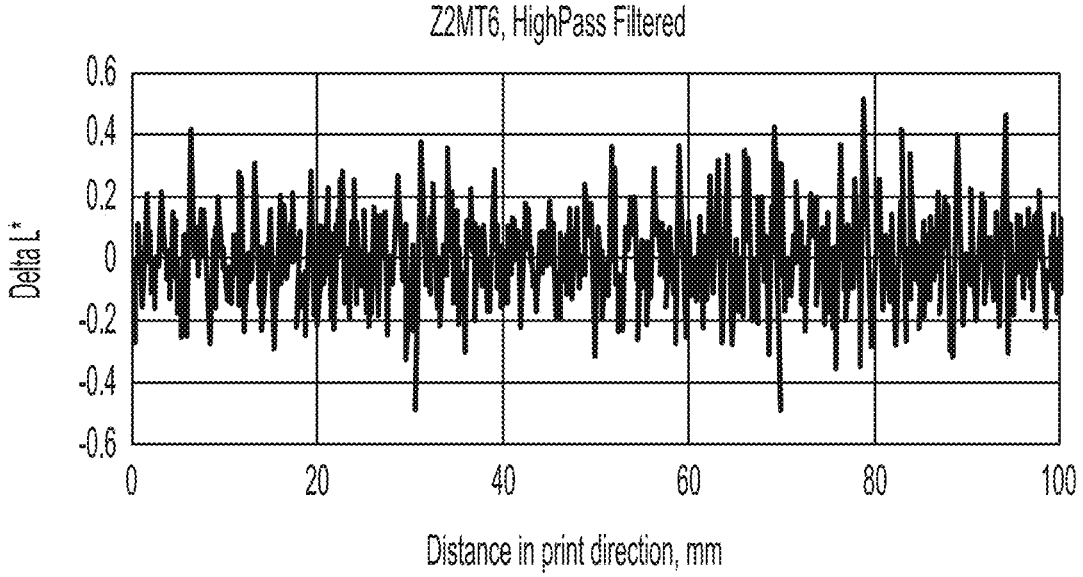

A uniform flat midtone grey image was printed at 0.1 inch/second on a commercially-available PanDigital PANPRINT01 printer (Amazon.com), using both the commercially available Z2MT6 print paper and the novel "upside-down" C0064-130 structure (CMY) media. FIG. 11 and the following tables provide quantitative confirmation of the benefits of making this change in the color order. FIG. 11 compares the high spatial frequency fluctuations in luminance between the conventional Z2MT6 structure (YMC) and the "upside-down" C0064-130 structure (CMY). The latter structure has moved the yellow layer to the position furthest from the heated surface, and therefore to the position where the density fluctuations will be largest. This increases the density fluctuations in yellow. However, the fluctuations in the density of yellow dye have relatively much smaller effect on the luminance fluctuations than similarly sized fluctuations in the density of cyan, so the exchange is beneficial. At the same time, the cyan composition has been moved to layer 306, where the size of the cyan density fluctuations is smaller because of the smaller slope of the response function. The graphs below show the luminance fluctuations measured when a flat, uniform midgrey density is printed. As seen in the graphs in FIG. 11, the net size of the fluctuations in luminance were reduced by a factor of two by the exchange.

| High Frequency = 0.5 –> 10 cycles/mm | | | |
|---|---|---|---|
| High Frequency | RMS Delta L* | RMS Delta a* | RMS Delta b* |
| C0064-130: | 0.06 | 0.05 | 0.09 |
| Z2MT6: | 0.12 | 0.11 | 0.16 |

FIG. 11 related to data that was filtered to include only spatial frequencies from 0.5-10 cycles/mm. The sample prints were printed at 300 pixels/inch and had a pixel dimension of 85 μm, so it represents fluctuations that extend over regions of about 1-20 pixels.

Figure 12:
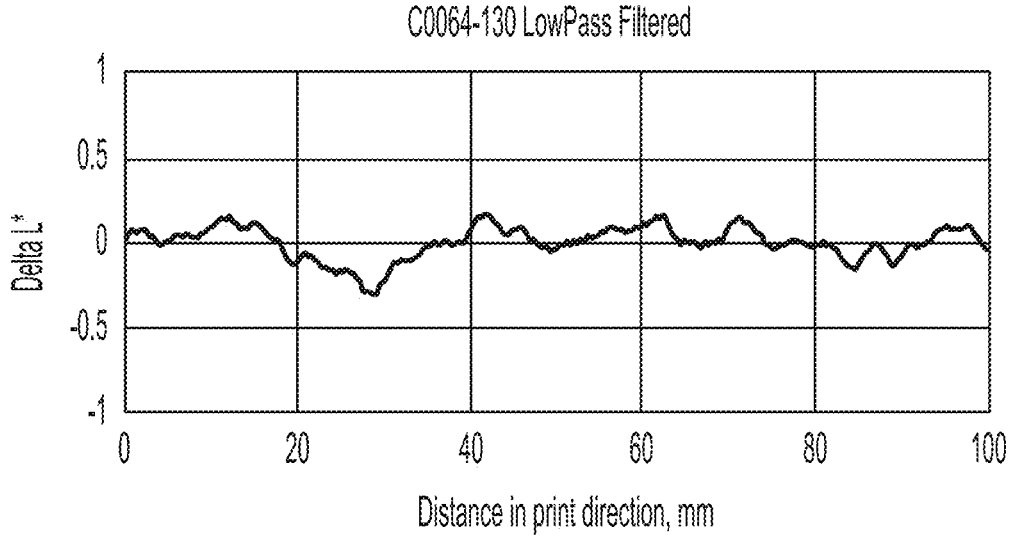
FIG. 12 provides a comparison of the filtered data, containing only low spatial frequencies from 0.0135-0.5 cycles/mm, between the conventional Z2MT6 structure (YMC) and the "upside-down" C0064-130 structure (CMY).
Figure 12:
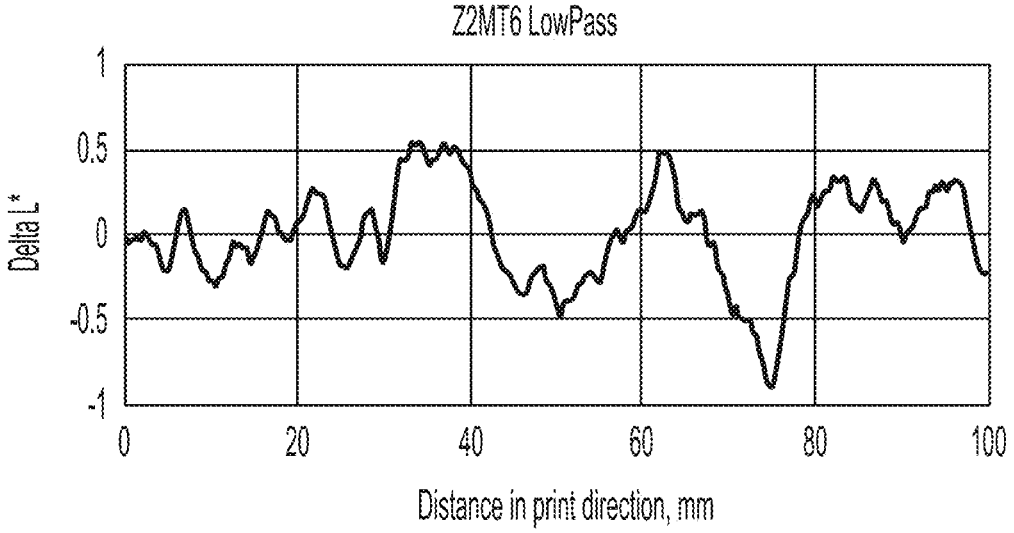

There are also variations in media properties that extend over longer distances and represent more gradual and longer-range variations. These are likely to be the result of small changes in the coating thicknesses of the individual layers, or to gradual changes in the temperature of the printer while printing. Yet the effects of these variations are governed by the same considerations as the short-range fluctuations. FIG. 12 illustrates data that were filtered to contain only low spatial frequencies from 0.0135-0.5 cycles/mm, which represent variations that extend over 24-870 pixels in the image. The RMS variation in luminance was once again reduced substantially by swapping the order of the cyan and yellow layers, and this time by a factor of about 4.

| Low Frequency = 0.0135 –> 0.5 cycles/mm | | | |
|---|---|---|---|
| Low Frequency | RMS Delta L* | RMS Delta a* | RMS Delta b* |
| C0064-130: | 0.08 | 0.11 | 0.43 |
| Z2MT6: | 0.33 | 0.31 | 0.5 |

As before, if the data was considered as separated into colors representative of the three-color layers, it was observed that, with the change from the conventional YMC order of sample Z2MT6 to the upside-down CMY order of C0064-130, the density variations of the Y layer were increased as a result of moving to the position of layer 302, most distant from the surface. The density variations of the C layer were very substantially reduced by moving it close to the surface in the position of layer 306. Because of the much smaller contribution of the Y variations to the luminance, this trade-off was beneficial and led to an overall reduction of 4 in the luminance variations.

Figure 4:
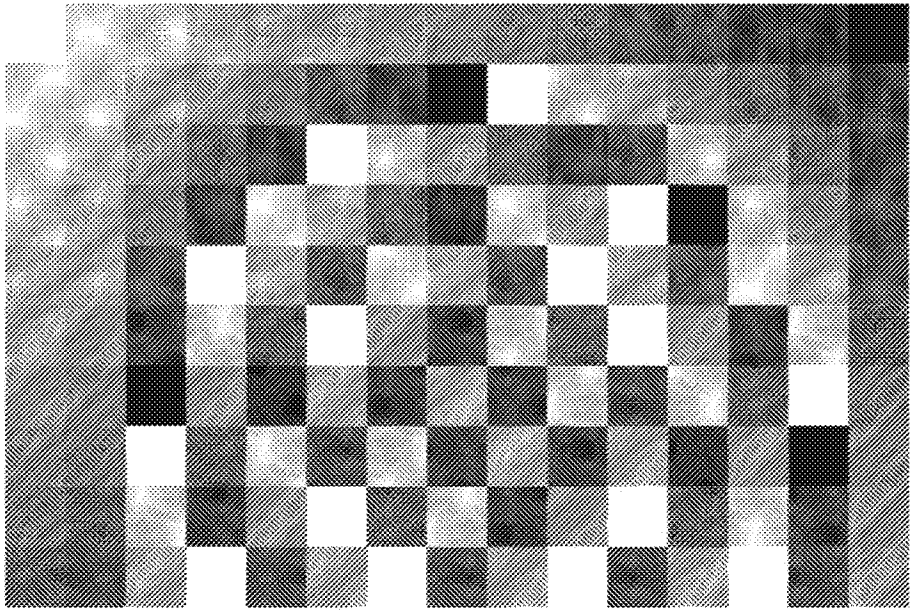
FIG. 4 is an example of an image used in the determination of subjective quality factor (SQF).
Figure 5:
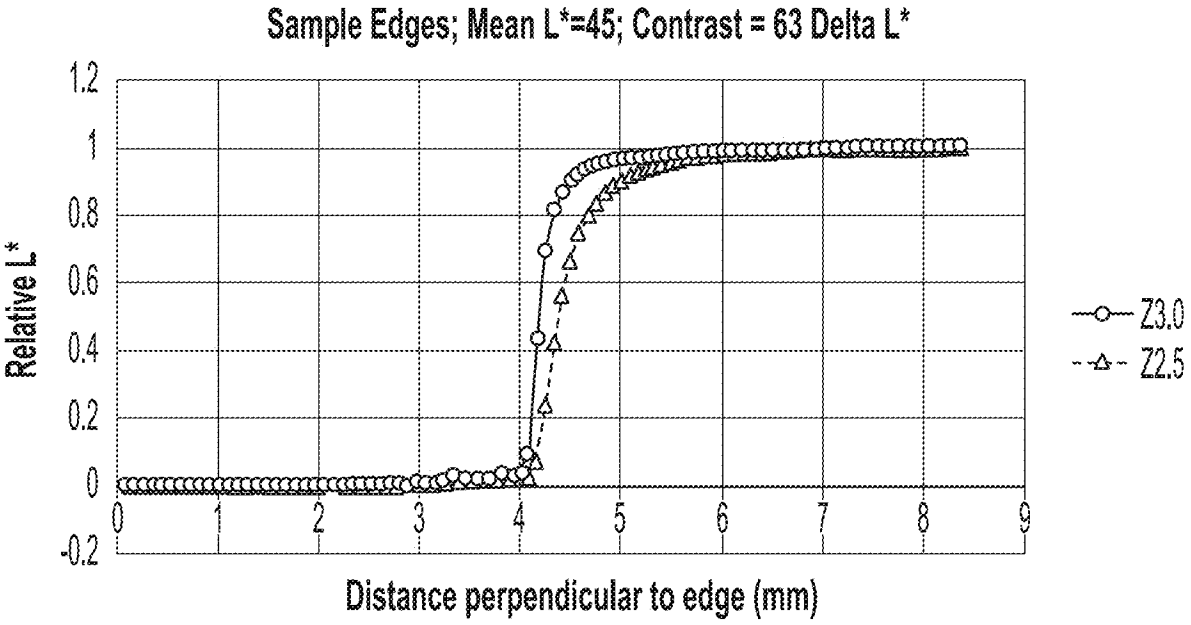
FIG. 5 is an example of a line graph of the optical density transitions that take place across the edges between squares of different density shown in FIG. 4.

Using the same printer, an SQF calibration image as shown in FIG. 4 was printed on both the commercially available Z2MT6 print paper and the novel "upside-down" C0064-130 structure (CMY) media. FIG. 13 shows the improvement in SQF that resulted from the change in the color order between these two media structures. The SQF itself is a sharpness measure whose value may depend on the luminance of the image around the edge for which it is being evaluated. Therefore, the measured improvement in SQF was plotted against the mean of the luminance on the two sides of the edge. The median SQF changed by 9 units, but at the low and high ends of the luminance range, it improved by 15 or more units.

Example 2 Comparison of the Conventional Z2.5 YMC Media with the "Upside-Down" CMY Media Two sample media were fabricated, using similar structures, but with different dye compositions. The first, identified as Z2.5, is a medium having the prior-art YMC color order with the yellow layer closest to the heated surface, and with magenta and then cyan layers sequentially more distant from the surface. It is available commercially, in roll form, under the "Brother CZ" and "ZINK hAppy" brand names. The second, identified as Z3.0, is a modified media having the locations of the yellow and cyan layers transposed and the compositions of these layers changed to achieve the appropriate thermal activation temperatures.

The Z3 media, with CMY color order, will be described in detail. Many of the chemical components are identical to those used in the above-described C0064-130 media, and the descriptions and sources of these ingredients are not repeated.

Figure 14:
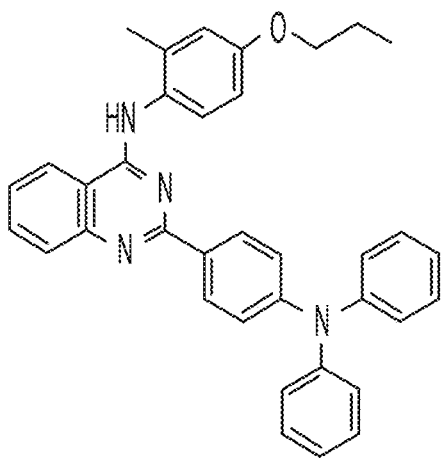
FIG. 14 provides the chemical structures of some of the components of the yellow layer of the second example "upside-down" Z3.0 media (CMY), namely the yellow dye ID1322 (FIG. 14*a*) and the acid developer AD139 (FIG. 14*b*).
Figure 14:
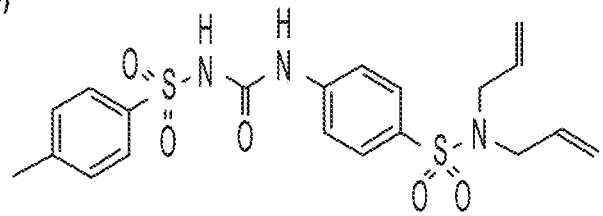

The yellow layer 302 of Z3 uses a dye with the structure shown in FIG. 14*a*, which is referred to herein as ID1322 and has systematic name is N,N-Diphenyl-4-(4-(2-methyl-4-oxypropyl)-phenyl-2-quinazolinyl)-benzenamine. It is combined with two thermal solvents, TS274 and TS425, which have been described above. Their structures are shown in FIG. 10*c* and FIG. 8*b*, respectively. The yellow layer also included an acid developer, referred to herein as AD139 and shown in FIG. 14*b*. Its systematic name is N,N-Diallyl-4-[[[[(4-methylphenyl) sulfonyl] amino] carbonyl] amino]-benzenesulfonamide.

The final coated density of yellow layer 302 is 3000 mg/m$^2$ and its composition, by weight percent is:

| | |
|---|---|
| ID1322 | 10.08% |
| TS274 | 10.08% |
| TS425 | 30.20% |
| AD139 | 30.20% |
| PVA RS1717 | 19.02% |
| Zonyl FSN | 0.42% |

The component PVA RS1717 is a modified poly-vinyl alcohol available from Kuraray America Inc. (Houston, Tex.). Zonyl FSN is a surfactant obtained from E.I. du Pont de Nemours (Wilmington, Del.).

Figure 15:
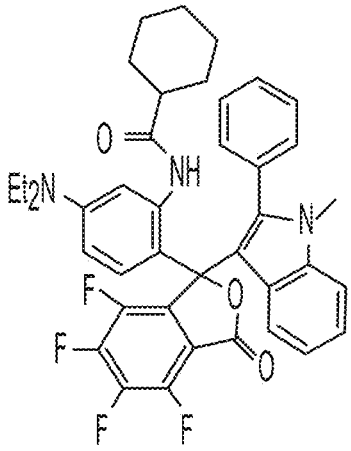
FIG. 15 provides the chemical structures of some of the components of the cyan layer of the second example "upside-down" Z3.0 media (CMY), namely the cyan dye ID1283 (FIG. 15*a*) and the acid developer AD134 (FIG. 15*b*).
Figure 15:
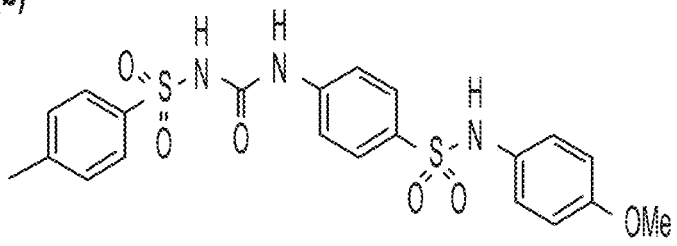

The cyan layer 306 uses a dye with the structure shown in FIG. 15*a*, referred to herein as ID1283. Its systematic name is N-[2-[1,3-Dihydro-1-(1-methyl-2-phenyl-1H-indol-3-yl)-3-oxo-1-tetrafluoro-isobenzofuranyl]-5-(diethylamino)phenyl]-cyclohexylamide. This dye is mixed with an acid developer having the structure shown in FIG. 15*b* and referred to as AD134. This compound has systematic name N-4-Methoxy-phenyl-4-[[[[(4-methylphenyl) sulfonyl] amino] carbonyl] amino]-benzenesulfonamide.

The final coated thickness of cyan layer 306 is 2590 mg/m$^2$ and its composition, by weight percent, is:

| | |
|---|---|
| ID1283 | 17.23% |
| AD134 | 52.60% |
| Cabojet 250C | $9.77 \times 10^{-4}$% |
| PHS-8E01 | 14.14% |
| PVA RS1717 | 15.49% |
| Alkonol XC | 0.18% |
| Zonyl FSN | 0.37% |

The component Cabojet 250C is a cyan tint produced by Cabot Corp. (Boston, Mass.). PHS-8E01 is poly(P-hydroxystyrene), obtained from Chem First Electronic Materials LP (Dallas, Tex.).

Magenta layer 304 in the Z3.0 CMY test structure has a magenta dye, designated herein as ID1036, and three thermal solvents TS274, TS376, and TS395. These four components have been described previously. The chemical structure of ID1036 is shown in FIG. 10*a*; that of TS274 is shown in FIG. 10*c*; that of TS376 is shown in FIG. 9*b*, and that of TS395 is shown in FIG. 10*b*.

The final coated weight of magenta layer 304 was 3000 mg/m$^2$ and its composition by weight percent is essentially identical to that in the previously described magenta layer of the Z2.5 YMC test sample:

| | |
|---|---|
| ID1036 | 8.92% |
| TS395 | 46.73% |
| TS274 | 5.31% |
| TS376 | 18.26% |
| PVA KL506 | 12.50% |
| PVA KL318 | 7.88% |
| Zonyl FSN | 0.40% |

In addition to the dye layers, the Z3 coating has two interlayers 303 and 305, and an overcoat 308.

Interlayer 303 had a coating weight of 10500 mg/m$^2$ and a composition by weight percent of:

| | |
|---|---|
| PB6692MNA | 58.39% |
| PVA MP103 | 19.81% |
| TS274 | 13.03% |
| CP655NA | 3.74% |
| Leucophor STR | 3.19% |
| CX100 | 1.67% |
| Zonyl FSN | 0.18% |

The component PB6692MNA is a styrene/butadiene rubber latex obtained from Dow Chemical Co. (Midland, Mich.). Leucophor STR is an optical brightener from Archroma US (Greenville, S.C.). PVA MP103 is a polyvinyl alcohol supplied by Kuraray America, Inc. (Houston, Tex.). CP655NA was obtained from Dow Chemical Co. (Midland, Mich.).

Interlayer 305 has a coating weight of 7500 mg/m$^2$ and its composition by weight percent was:

| | |
|---|---|
| PB6692MNA | 60.26% |
| TS274 | 14.45% |
| PVA MP103 | 25.00% |
| Zonyl FSN | 0.29% |

The overcoat 308 has a total coating weight of 3073 mg/m2 and a composition, by weight percent, of:

| | |
|---|---|
| DSIVMS7 | 27.80% |
| PVA 325_10 | 27.04% |
| Neocryl XK-101 | 9.60% |
| Bayhydur 304 | 7.81% |
| Zonyl FSN | 6.25% |
| Zinc Stearate | 5.50% |
| PVA MP103 | 4.63% |
| Rheolate 210 | 4.62% |
| Erucamide | 2.81% |
| ADH | 2.10% |
| Bacote 20 | 1.82% |
| Leucophor STR | 0.02% |

PVA 325_10 is a poly-vinyl alcohol available from Sekisui Specialty Chemicals America (Houston, Tex.). DSIVMS7 is a nanoparticulate grade of titanium dioxide from Kobo Products Inc. (South Plainfield, N.J.). Bayhydur 304 is a polyisocyanate from Covestro (Pittsburgh, Pa.).

Results

An SQF calibration image as shown in FIG. 4 was printed on both the commercially available Z2.5 print paper and the novel "upside-down" Z3.0 structure (CMY) media. The printer was a laboratory test-bed printer, printing at 0.3 inches per second (IPS) equipped with a conventional 300 DPI thermal head made by Alps-Alpine Corporation, (Yukigaya-otsukamachi, Ota-ku, Tokyo, Japan).

Figure 16:
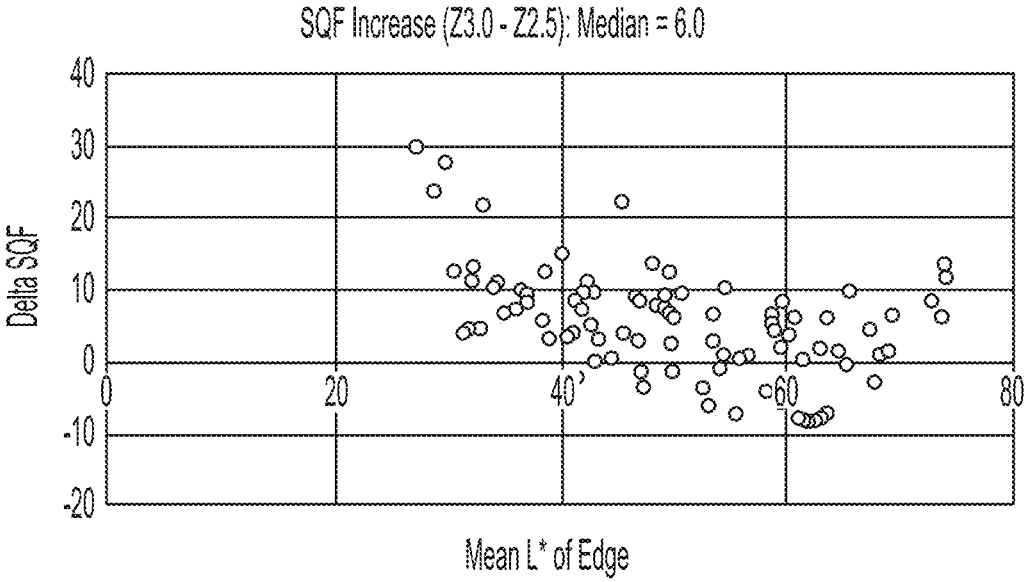
FIG. 16 illustrates the increase in SQF that results from a change in the color order of the dye layers from YMC to CMY in the second example "upside-down" Z3.0 structure.

FIG. 16 plots the difference in SQF between the Z3.0 and the Z2.5 structures and illustrates a general improvement SQF that results from a change in the color order of the dye layers from YMC to CMY. Insofar as SQF is a sharpness measure whose value may depend on the luminance of the image around the edge for which it is being evaluated, the SQF difference was plotted against the mean of the luminance on the two sides of the edge. This revealed that, particularly at the low and high ends of the luminance range, the subjective sharpness improved by a very significant 10-15 points. The median SQF over the entire range changed from 64 to 70, an improvement of 6 points.

Next, a uniform flat midtone grey image was printed at 0.3 IPS, using both the commercially available Z2.5 print paper and the novel "upside-down" Z3.0 structure (CMY) media.

Figure 17:
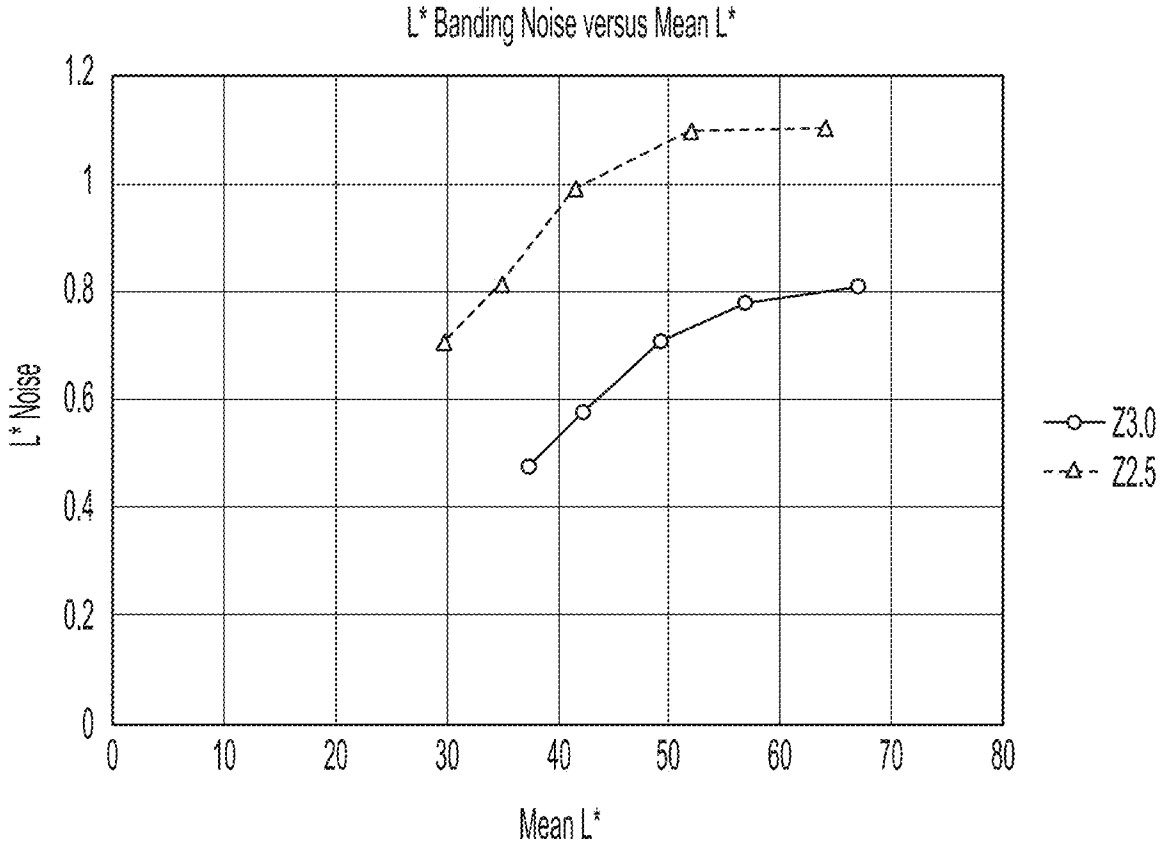
FIG. 17 provides a comparison of the banding noise (non-uniformity) between the conventional Z2.5 structure (YMC) and the second example "upside-down" Z3.0 structure (CMY).

FIG. 17 provides quantitative confirmation of the benefits to image uniformity of making the change in the color order. This figure compares the fluctuations in luminance between the Z2.5 structure (YMC) and the "upside-down" Z3.0 structure (CMY). The latter structure moved the yellow dye to layer 302 furthest from the heated surface, and therefore to the position where the optical density fluctuations will be largest. This increased the density fluctuations in yellow. However, the change also moved the cyan dye to layer 306, closest to heated surface where the optical density fluctuations will be lower. The fluctuations in the density of yellow dye had relatively much smaller effect on the luminance fluctuations than similarly sized fluctuations in the density of cyan, so the exchange was beneficial. The graph plots the luminance fluctuations measured when a flat, uniform mid-grey density is printed and shows that the net size of the fluctuations in luminance were reduced by 30-45% by the change in color order.

All patents and other publications; including literature references, issued patents, published patent applications, and patent applications; cited throughout this application are expressly incorporated herein by reference for the purpose of describing and disclosing, for example, the methodologies described in such publications that might be used in connection with the technology described herein. These publications are provided solely for their disclosure prior to the filing date of the present application. Nothing in this regard should be construed as an admission that the inventors are not entitled to antedate such disclosure by virtue of prior invention or for any other reason. All statements as to the date or representation as to the contents of these documents is based on the information available to the applicants and does not constitute any admission as to the correctness of the dates or contents of these documents.

The foregoing written specification is considered to be sufficient to enable one skilled in the art to practice the present aspects and embodiments. The present aspects and embodiments are not to be limited in scope by examples provided, since the examples are intended as a single illustration of one aspect and other functionally equivalent embodiments are within the scope of the disclosure. Various modifications in addition to those shown and described herein will become apparent to those skilled in the art from the foregoing description and fall within the scope of the appended claims. The advantages and objects described herein are not necessarily encompassed by each embodiment. Those skilled in the art will recognize, or be able to ascertain using no more than routine experimentation, many equivalents to the specific embodiments described herein. Such equivalents are intended to be encompassed by the following claims.

We claim:

1. A method of improving the perceived image sharpness of a multicolor direct thermal printer output comprising using an output medium having a bottom color-forming layer of yellow (Y), wherein the perceived image sharpness is reflected in an improved median subjective quality factor (SQF) of at least 10 points in the low and high ends of the luminance range.

2. The method of improving the perceived image sharpness of claim 1, wherein the output medium further comprises a top color-forming layer of cyan (C).

3. The method of improving the perceived image sharpness of claim 1, wherein the output medium further comprises:

a first inert layer between the top and middle color-forming layers; and a second inert layer between the middle and bottom color-forming layers.

4. The method of improving the perceived image sharpness of claim 3, wherein the cyan color former is the top color-forming layer, and the magenta color former is the middle color-forming layer.

5. The method of improving the perceived image sharpness of claim 1, wherein the output medium has:

a surface;

a top color-forming layer of cyan (C);

a middle color-forming layer of magenta (M); and a bottom color-forming layer of yellow (Y).

6. The method of improving the perceived image sharpness of claim 5, wherein the output medium further comprises:

a first inert layer between the top and middle color-forming layers; and a second inert layer between the middle and bottom color-forming layers.

7. The method of improving the perceived image sharpness of claim 1, wherein the perceived image sharpness is reflected in an improved median subjective quality factor (SQF) of at least 15 points in the low and high ends of the luminance range.

8. A method of improving the print uniformity of a multicolor direct thermal printer output comprising using an output medium having a bottom color-forming layer of yellow (Y), wherein the print uniformity is reflected in a lowering of the level of luminance fluctuations in the print of a uniform density mid-level grey image by at least 30%.

9. The method of claim 8, wherein the output medium further comprises a top color-forming layer of cyan (C).

10. A method of improving the print uniformity of a multicolor direct thermal printer output comprising using an output medium having three separate color-forming layers capable of forming the colors cyan (C), magenta (M) and yellow (Y) and comprising a top, middle, and bottom color-forming layer, wherein the yellow color former is the bottom color-forming layer, wherein the print uniformity is reflected in a lowering of the level of luminance fluctuations in the print of a uniform density mid-level grey image by at least 30%.

11. The method of improving the print uniformity of claim 10, wherein the output medium further comprises:

a first inert layer between the top and middle color-forming layers; and a second inert layer between the middle and bottom color-forming layers.

12. The method of improving the print uniformity of claim 10, wherein the cyan color former is the top color-forming layer, and the magenta color former is the middle color-forming layer.

13. A method of improving the print uniformity of a multicolor direct thermal printer output comprising using an output medium having:

a surface;

a top color-forming layer of cyan (C);

a middle color-forming layer of magenta (M); and a bottom color-forming layer of yellow (Y), wherein the print uniformity is reflected in a lowering of the level of luminance fluctuations in the print of a uniform density mid-level grey image by at least 30%.

14. A method of improving the print uniformity of a multicolor direct thermal printer output comprising using an output medium having:

a multicolor direct thermal printer comprising one or more print heads, each of the one or more print heads containing a linear array of heating elements; and an output medium, the output medium transported past the print head elements to produce a two-dimensional image, the output medium comprising:

a surface;

a top color-forming layer of cyan (C);

a middle color-forming layer of magenta (M);

a bottom color-forming layer of yellow (Y);

a first inert layer between the top and middle color-forming layers; and a second inert layer between the middle and bottom color-forming layers, wherein the print uniformity is reflected in a lowering of the level of luminance fluctuations in the print of a uniform density mid-level grey image by at least 30%.

* * * * *